US010456312B1

(12) United States Patent
Cashatt

(10) Patent No.: US 10,456,312 B1
(45) Date of Patent: Oct. 29, 2019

(54) EXAMINATION CHAIR

(71) Applicant: Zachary Gray Cashatt, Pleasant Garden, NC (US)

(72) Inventor: Zachary Gray Cashatt, Pleasant Garden, NC (US)

(73) Assignee: Images of America, Inc., Thomasville, NC (US)

( * ) Notice: Subject to any disclaimer, the term of this patent is extended or adjusted under 35 U.S.C. 154(b) by 37 days.

(21) Appl. No.: 15/955,967

(22) Filed: Apr. 18, 2018

(51) Int. Cl.

| | |
|---|---|
| ***A61G 15/02*** | (2006.01) |
| ***A61G 15/00*** | (2006.01) |
| ***A61G 7/16*** | (2006.01) |
| *A61G 13/00* | (2006.01) |
| *A61G 5/10* | (2006.01) |

(52) U.S. Cl.
CPC ..... *A61G 15/02* (2013.01); *A61G 7/16* (2013.01); *A61G 15/005* (2013.01); *A61G 5/1059* (2013.01); *A61G 13/0018* (2013.01)

(58) Field of Classification Search
USPC ..... 297/188.17
See application file for complete search history.

(56) References Cited

U.S. PATENT DOCUMENTS 3,632,161 A * 1/1972 Arfaras ..... A47C 7/70 297/145
3,845,945 A * 11/1974 Lawley ..... A61G 15/005 5/602
4,155,126 A * 5/1979 Classen ..... A61G 5/006 297/153
4,907,775 A * 3/1990 Lorence ..... B60N 3/102 248/311.2
6,145,931 A * 11/2000 Subotic ..... A47C 7/506 297/188.11
7,093,904 B1 * 8/2006 McMillen ..... A47C 7/543 297/411.32
D622,516 S * 8/2010 Delmestri ..... D6/367
8,662,588 B1 3/2014 Delmestri
2006/0168727 A1 * 8/2006 Heimbrock ..... A61G 7/0755 5/602
2009/0049603 A1 * 2/2009 Martin ..... A61G 5/10 5/83.1
2009/0235457 A1 * 9/2009 Harvey ..... A61G 13/0009 5/624
2013/0181498 A1 * 7/2013 Hsuan-Chin ..... A47C 1/035 297/423.19
2016/0302987 A1 * 10/2016 Bochner ..... A61G 13/1245
2019/0117489 A1 * 4/2019 Labedz ..... A61G 13/0036

* cited by examiner

*Primary Examiner* — David E Allred
(74) *Attorney, Agent, or Firm* — Tuggle Duggins P.A.; Blake P. Hunt

(57) ABSTRACT

An examination chair has a seating surface, a back surface that is movable between a first position generally perpendicular to the plane of the seating surface and a second position generally parallel to and co-planar with the seating surface, a pair of arm members, disposed on opposite sides of the seating surface, each of the arm members having an upper section pivotally mounted to a lower section to enable the upper section to pivot away from the seating surface to permit greater access to a patient in the chair, each arm further containing a retractable stirrup member in the lower section thereof, and a scissor lift pivotally mounted to a carriage beneath the seating surface such that, when actuated, the scissor lift will raise and lower the seating surface.

16 Claims, 6 Drawing Sheets

EXAMINATION CHAIR

FIELD OF THE INVENTION

The invention herein pertains to an examination chair and particularly pertains to a convertible examination chair with vertical lift and retractable stirrups.

DESCRIPTION OF THE PRIOR ART AND OBJECTIVES OF THE INVENTION

Furniture used for medical examination purposes is well known. Most common is a simple examination table having a planar surface on which the patient can recline during the examination. Also common are furniture pieces that are specifically designed for a particular type of examination, such as gynecological examinations. Still other furniture is employed for general seating, not only in the waiting room, but also in the examination room. Equipping a facility that performs medical examinations with multiple different types of furniture for examinations and general seating is expensive. In many medical care facilities, particularly nursing homes and similar elderly care facilities, moving the patient from one piece of furniture to another is problematic and disadvantageous.

There is a need for a single piece of furniture that can fulfill multiple functions as comfortable seating, and also be used for a variety of medical examinations.

Thus, in view of the problems and disadvantages associated with prior art devices, the present invention was conceived and one of its objectives is to provide an examination chair that can provide comfortable seating and also be used for a variety of medical examination purposes.

It is another objective of the present invention to provide an examination chair that can recline to function as an examination table.

It is still another objective of the present invention to provide an examination chair having a scissor lift for height adjustability.

It is yet another objective of the present invention to provide an examination chair having retractable stirrups.

It is yet a further objective of the present invention to provide an examination chair having pivotable, dropdown arms.

It is still a further objective of the present invention to provide an examination chair having lockable casters for ease in movement.

Various other objectives and advantages of the present invention will become apparent to those skilled in the art as a more detailed description is set forth below.

SUMMARY OF THE INVENTION

The aforesaid and other objectives are realized by providing an examination chair having a seating surface and a back surface that is movable between a first position generally perpendicular to the plane of the seating surface and a second position generally parallel to and co-planar with the seating surface, allowing the chair to go from a seating to a laying position. The examination chair further includes two arm members, disposed on opposite sides of the seating surface, each of the arm members containing retractable stirrup members. Further, each arm member includes an upper section pivotally mounted to a lower section, allowing the upper section to pivot outwardly away from the seating surface to permit greater access to a patient in the chair. The examination chair further includes a scissor lift pivotally mounted to a carriage beneath the seating surface such that, when actuated, the scissor lift will raise and lower the seating surface. Lockable casters are positioned proximate each corner of the carriage to assist in movement of the examination chair as needed.

DETAILED DESCRIPTION OF THE PREFERRED EMBODIMENT AND OPERATION OF THE INVENTION

Figure 1:
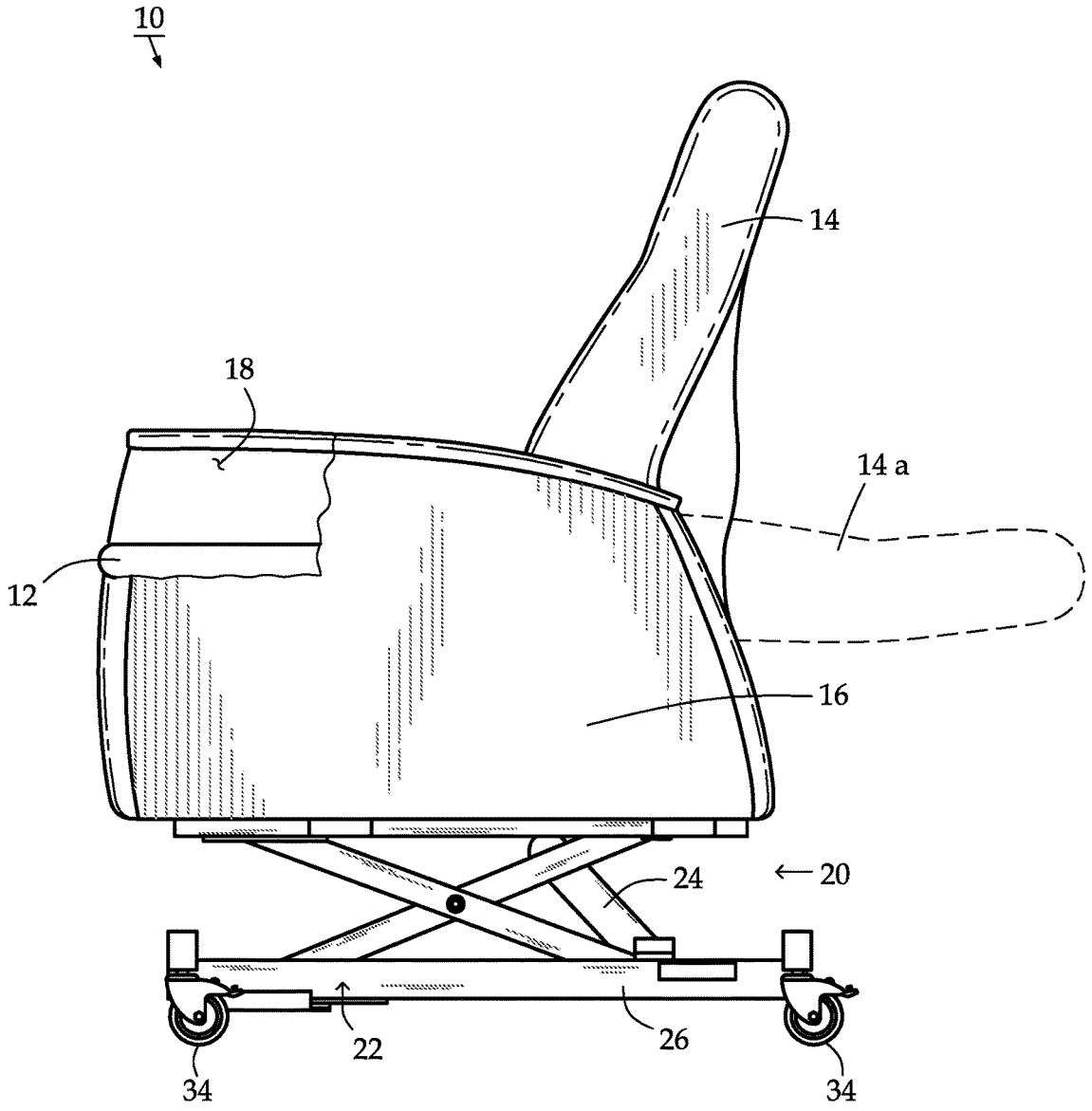
FIG. 1 is a partially fragmented side view of an examination chair.

For a better understanding of the invention and its operation, turning now to the drawings, FIG. 1 shows a side view of an examination chair 10 having a seating surface 12, a back surface 14 and a pair of arms 16, 18 disposed on opposite sides of the seating surface 12. Back surface 14 is structured to move between a seating position, wherein the back surface 14 is disposed generally perpendicular to the seating surface 12 and a reclined position (shown in FIG. 1 in dotted fashion and indicated as 14*a*), wherein the back surface is disposed generally parallel to and co-planar with, the seating surface 12. Although not shown as would be understood, examination chair 10 may include a footrest that simultaneously extends from the front when back surface 14 is reclined or is separately extensible.

Figure 2:
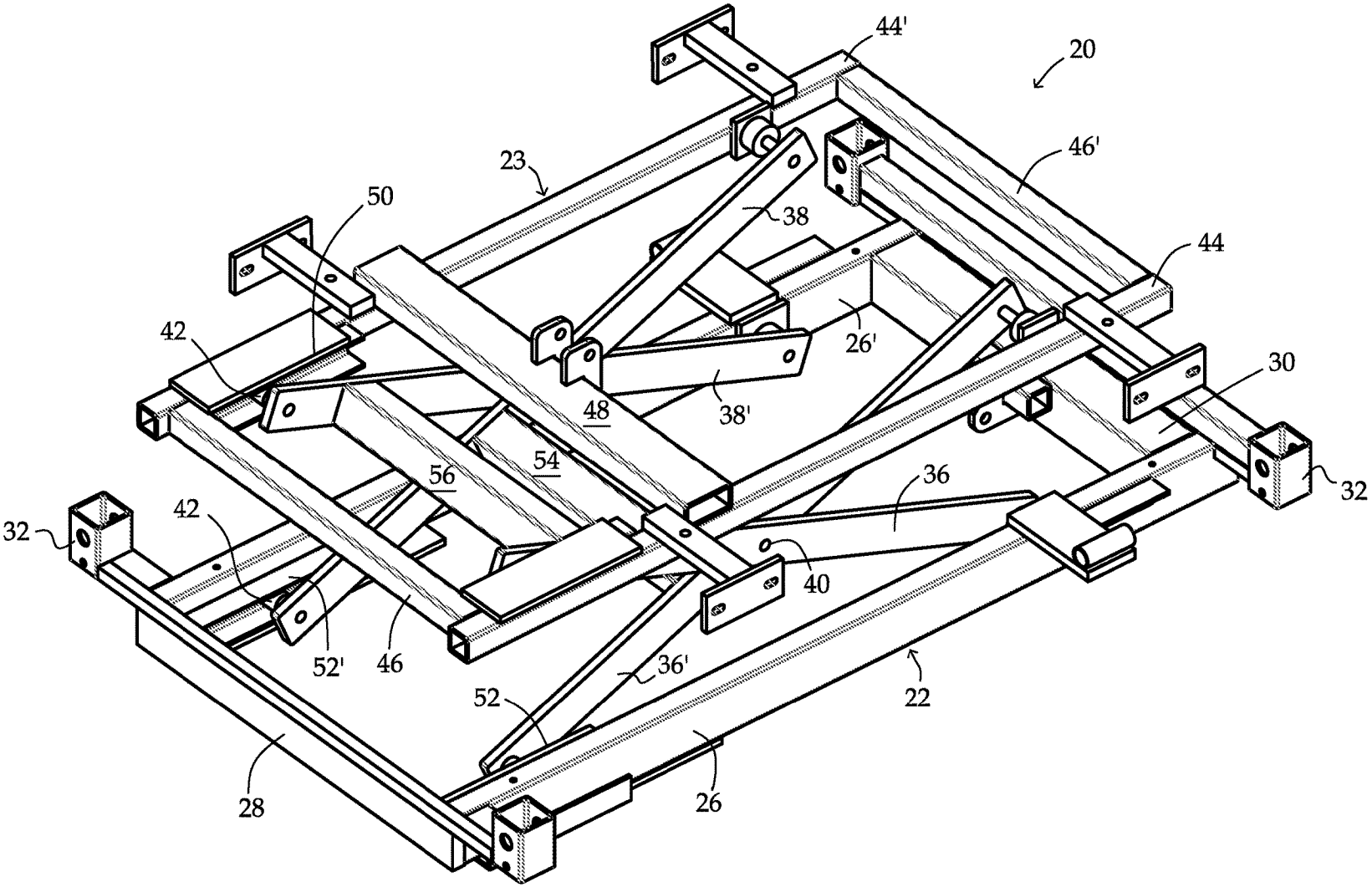
FIG. 2 is an isolated perspective view of the scissor lift assembly for the examination chair.
Figure 3:
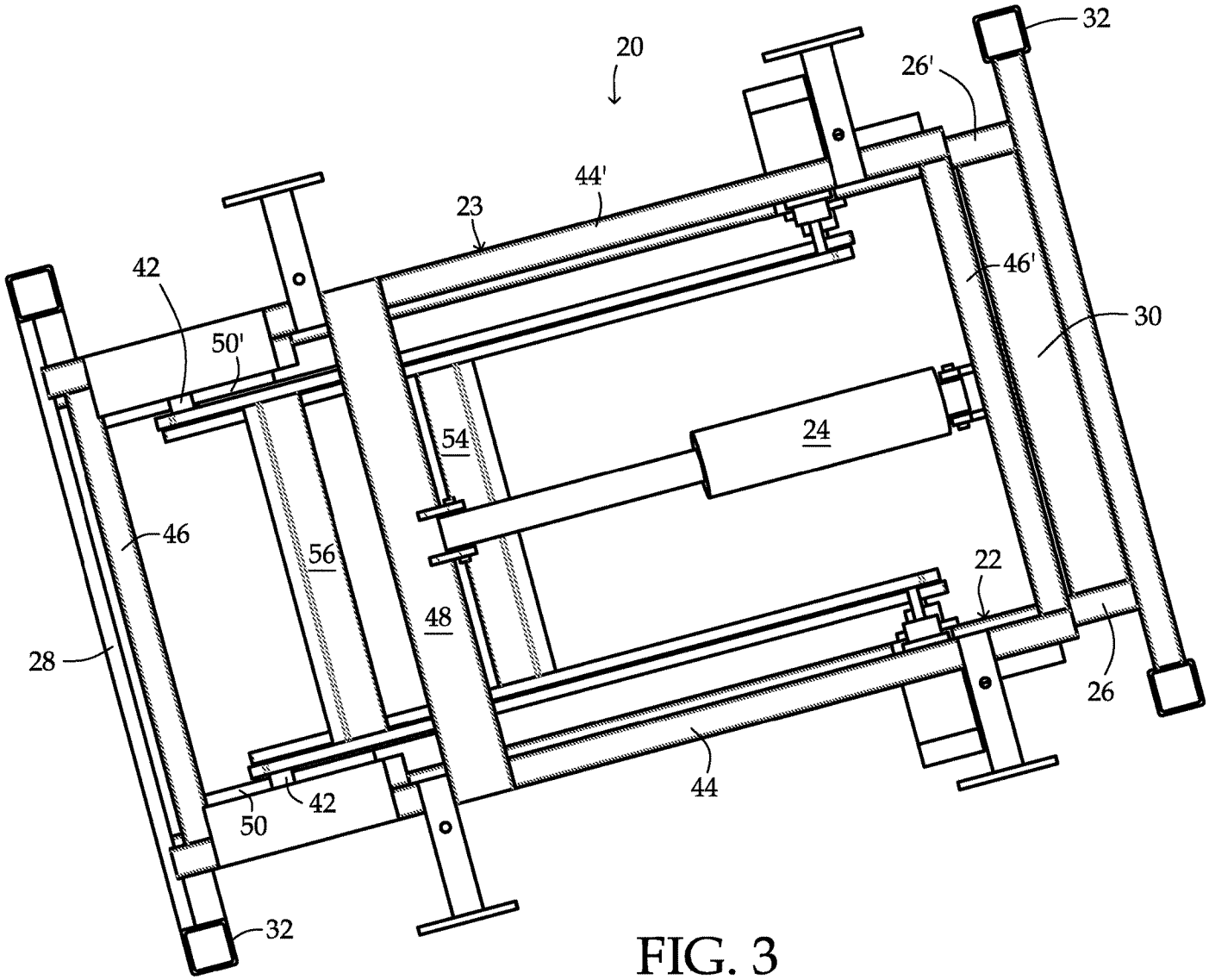
FIG. 3 is an isolated plan view of the scissor lift assembly for the examination chair.

Examination chair 10 further includes a scissor lift mechanism designated generally as 20. In preferred embodiments, scissor lift 20 is formed from rigid steel to provide for support of different weights and stability during repeated use, although aluminum or other materials as suitable may also be used. With particular reference to FIGS. 1-3, scissor lift 20 includes rectangular lower carriage 22 and an upper carriage 23. The lower carriage 22 and upper carriage 23 are operationally connected to one another by a lifting device 24 (not shown in FIG. 2) and scissor arms 36, 36', 38, 38'. Lower carriage 22 has tubular members 26, 26' that form the longer lengths of the rectangle, a flat plate member 28 that forms the front rail of carriage 22, and a tubular member 30 that forms a rear cross rail of the carriage 22. The plate member 28 and tubular member 30 are fixedly secured to the tubular members 26, 26' such as by welding or other means used for securing metal members together.

Lower carriage 22 has four castor tubes 32 located at the corners of the lower carriage 22 for use in attaching castors 34 (shown in FIG. 1, not illustrated in FIG. 2 or 3). Castors 34 may be attached to the lower carriage 22 by conventional means such as bolts and allow the carriage and the examination chair to move easily from one location to another, even with a person sitting thereon. The castors 34 are preferably of the locking variety to facilitate locking the examination chair in a desired location and position without fear of inadvertent motion.

Upper carriage 23 is formed from tubular members 44, 44' which form the longer sides of the rectangle, and tubular members 46, 46' which form the shorter sides of the rectangle. A forward cross brace 48 is connected to tubular members 44, 44'. These members may be attached together by any suitable means, preferably by welding. Cross brace 48 provides structural rigidity to the upper carriage 23 and also provides a mounting location for one end of lifting device 24, the other end of which is attached to rear cross rail 30 of lower carriage 22, as seen in FIG. 3.

Scissor lift 20 further includes scissor arms 36, 36', 38, 38' which are preferably rigid metal bars. The scissor arms are connected to one another in pairs such that one scissor arm may rotate relative to the other in the pair about the center axis 40 of the scissor arm. The rearward ends of the scissor arms 36, 38' are pivotally attached to tubular member 26, 26', respectively, of the lower carriage 22, proximate to the rear cross rail 30. The forward ends of scissor arms 36, 38' contain rollers 42. Rollers 42 are disposed within channel rails 50, 50' which are attached to the tubular members 44, 44' proximate to the tubular member 46 of upper carriage 23. The rearward ends of the scissor arms 38, 36' are pivotally attached to tubular members 44', 44, respectively of the upper carriage 23, proximate to the tubular member 46'. The forward ends of scissor anus 38, 36' contain rollers 42. Rollers 42 are disposed within channel rails 52, 52' which are attached to the tubular members 26, 26' proximate to the front rail 28 of lower carriage 22.

Cross braces 54, 56 may be used to provide structural rigidity to the scissor arms, forward of the center axis 40, as shown in FIGS. 2 and 3. During operation, the lifting device 24 will be activated whereby ram 25 of lifting device 24 will either extend or retract, depending on the desired operation. As the ram 25 extends, it causes the distance between the cross rail 30 and cross brace 48 to increase, which opens the scissor arms 36, 36', 38, 38', causing rollers 42 to slide within their respective channel rails 50, 50', 52, 52', thus raising the upper carriage 23 relative to the lower carriage 22, which, in turn, raises the seating surface 12 of examination chair 10. Conversely, as the ram 25 of lifting device 24 is retracted, the scissor arms will close, rollers 42 will slide forwardly within their respective channel rails, and the upper carriage will be drawn downwardly and in close proximity to the lower carriage 22, thus lowering the seating surface 12 of examination chair 10. Actuation of the lifting device, which is preferably electrically operated, can be accomplished by any known means, such as a switch (not shown). In one preferred embodiment, the lifting device is a screw-fed electric actuator with capability to push up to 6000N and pull up to 4000N.

As noted above, the exam chair 10 features a reclining back surface 14. The reclining features may be of any known design, such as that taught in U.S. Pat. No. 8,662,588, the disclosure of which is incorporated by reference in its entirety.

Figure 4:
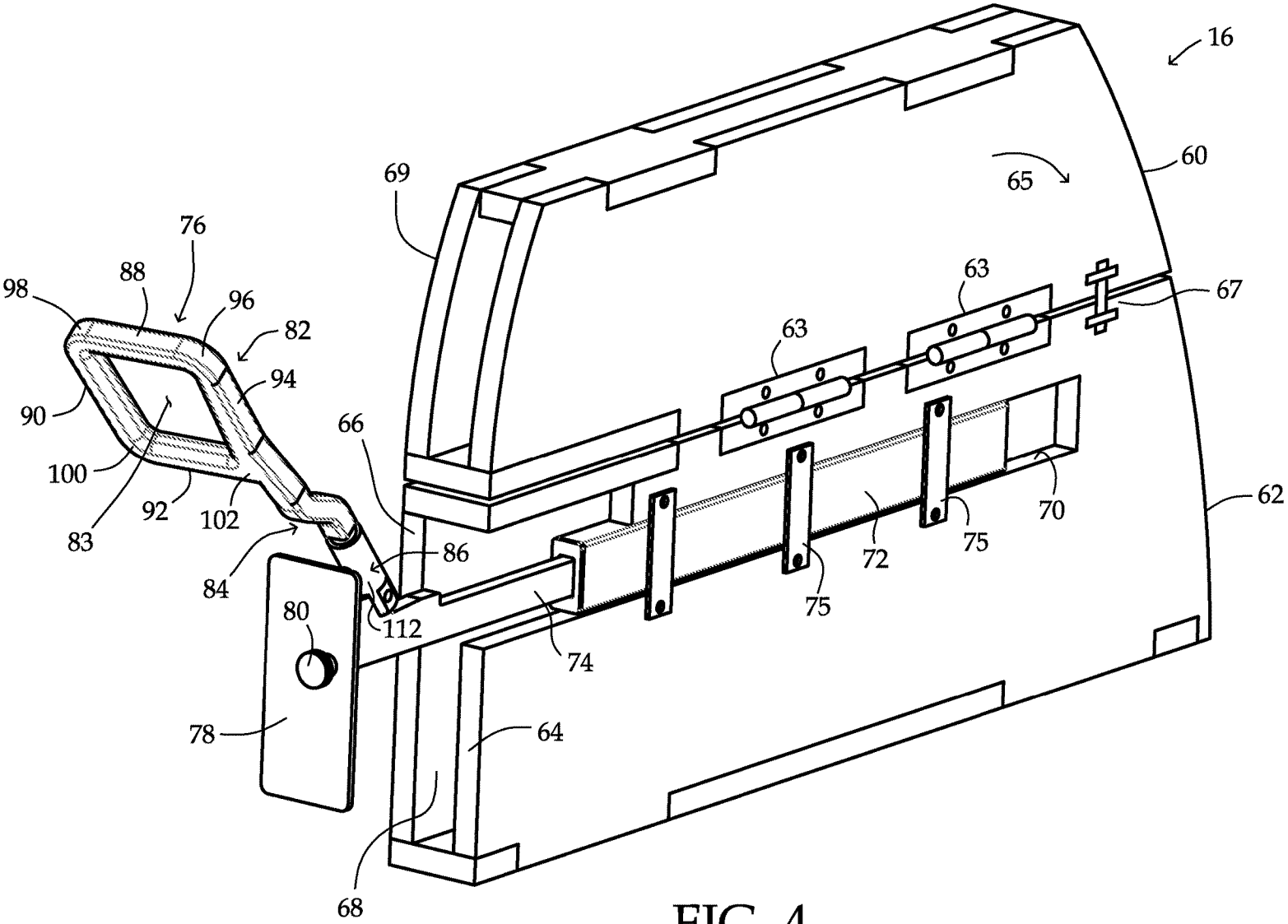
FIG. 4 is an isolated perspective view of an arm member for an examination chair, particularly illustrating the retractable stirrup.

With reference to FIG. 4, illustrated therein is an isolated perspective view of an arm, such as arm 16 of examination chair 10, particularly illustrating the retractable stirrup. In use, the arm 16 may be covered in fabric to provide an aesthetically pleasing appearance. For ease of explanation and illustration, no coverings are illustrated in FIG. 4.

The arm 16 has an upper section 60 and a lower section 62. The upper section 60 is connected to lower section 62 by hinges 63. In this configuration, the upper section 62 may be pivoted outward, in the general direction of arrow 65, whereby upper section 60 would be adjacent to and alongside of lower section 62. In this manner, the upper section 60 can be moved out of the way of medical personnel or other caregiver and provide greater access to the patient, or to facilitate movement of the patient from the exam chair to stretcher, operating table, etc., or simply to facilitate a patient's entry and exit from the exam chair. While FIG. 4 illustrates a plurality of hinges 63, it will be understood that a single long hinge may also be used to advantage. Similarly, while the hinges 63 are shown as simple barrel & pin style hinges, other hinges may be substituted as desired.

The upper section 60 or lower section 62 of arm 16 may also be provided with a catch or latch mechanism to hold the upper section 60 and lower section 62 in the linear, co-planar and upright position shown in FIG. 4. Such a mechanism might be any suitable device, such as a toggle latch, bail latch, draw latch, grabber catch, magnetic catch, etc. Alternatively, a simple slide bolt 67 may be used to prevent undesired movement of the upper section 60 relative to lower section 62.

Lower section 62 of arm 16 has an outer panel 64 and an inner panel 66, which are spaced apart from one another to form an opening 68 therebetween. Outer panel 64 has a channel opening 70 which houses a stirrup slide tube 72. A stirrup slide 74 is engaged in sliding relationship with the stirrup slide tube 72 whereby the distance between foot stirrup 76 and arm 16 can be increased or decreased. A face plate 78 is attached to the stirrup slide 74 and a grip knob 80 is provided on the face plate to facilitate sliding the stirrup slide 74 in and out of the stirrup slide tube 72. Face plate 78 will also provide a more decorative appearance and conceal the foot stirrup 76, stirrup slide 74 and opening 68 when the foot stirrup 76 is fully retracted into the arm 16. The stirrup slide tube 72 may be secured relative to the lower section 62 of arm 16 by a plurality of straps 75, for example, although other means can be used if desired.

Foot stirrup 76 may be provided with a detent feature to secure the stirrup in position relative to the arm 16 during use. In one embodiment, shown in FIG. 5, the stirrup slide 74 is provided with a plurality of spaced-apart notches 104 on the lower edge 106 of stirrup slide 74. As the stirrup slide 74 is pulled from the stirrup slide tube 72 (shown partially sectioned in FIG. 5), the notches would sequentially engage pin 108 and provide a positive stop for the stirrup. Lifting the loop portion 82 of the foot stirrup 76 slightly would disengage the notch 104 from pin 108 and permit the stirrup slide 74 to be moved in or out of stirrup slide tube 72.

Figure 5:
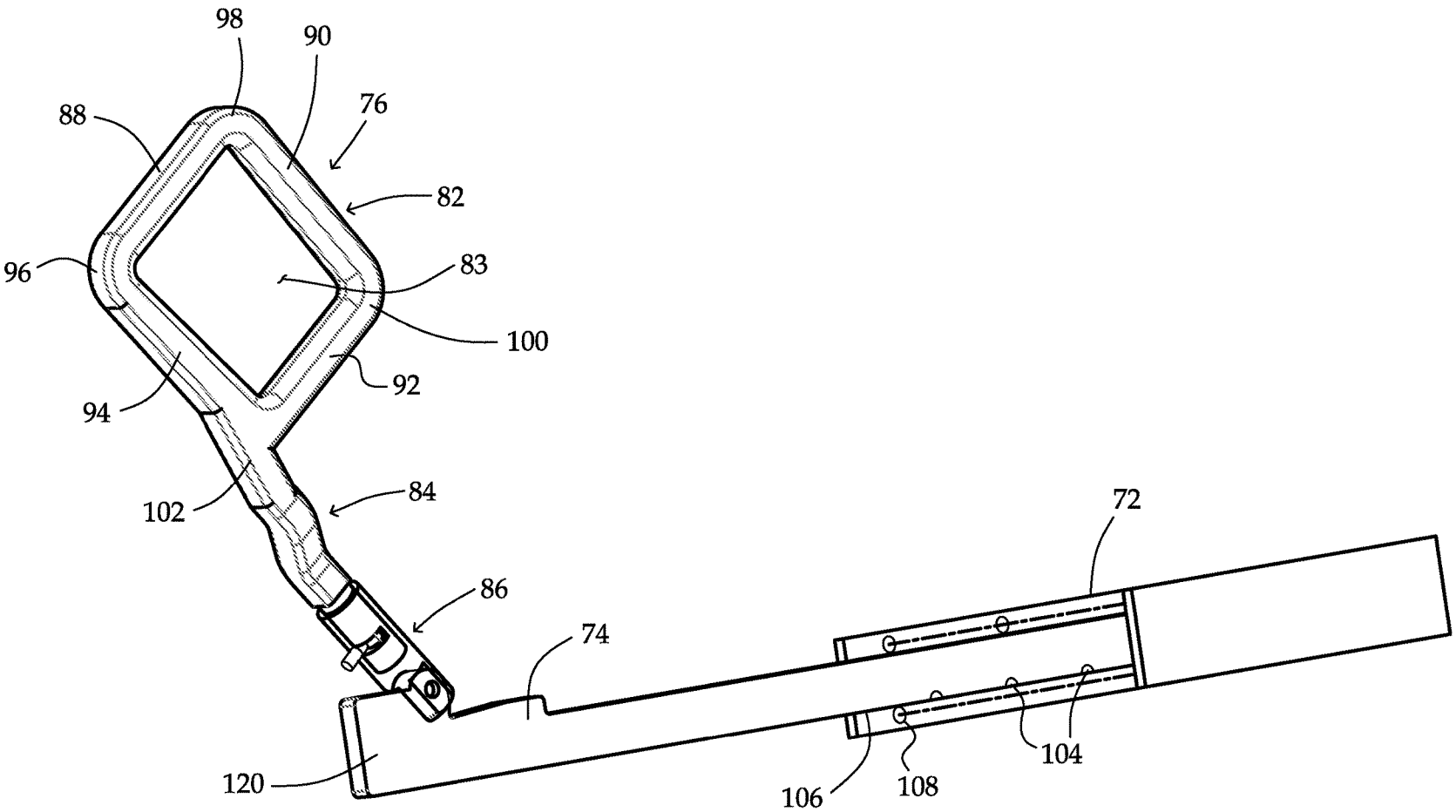
FIG. 5 is an isolated perspective view of a stirrup for the examination chair.

With reference to FIGS. 4 and 5, the foot stirrup 76 has a loop portion 82, a neck portion 84, and a pivot section 86. The loop portion 82 is shown as a generally square structure with a central aperture 83 defined by a plurality of legs 88, 90, 92, 94 and corners 96, 98, 100 and y-section 102 arranged to form a polygon, with the y-section 102 and neck portion 84. Aperture 83 is suited to accommodate the heel or forefoot of a patient undergoing an examination. Neck portion 84 of stirrup 76 has an S-shaped configuration, providing a slight bend in the neck to position the loop portion 82 generally aligned with the inside surface 69 of arm 16, which increases the comfort of the patient during use.

Figure 6:
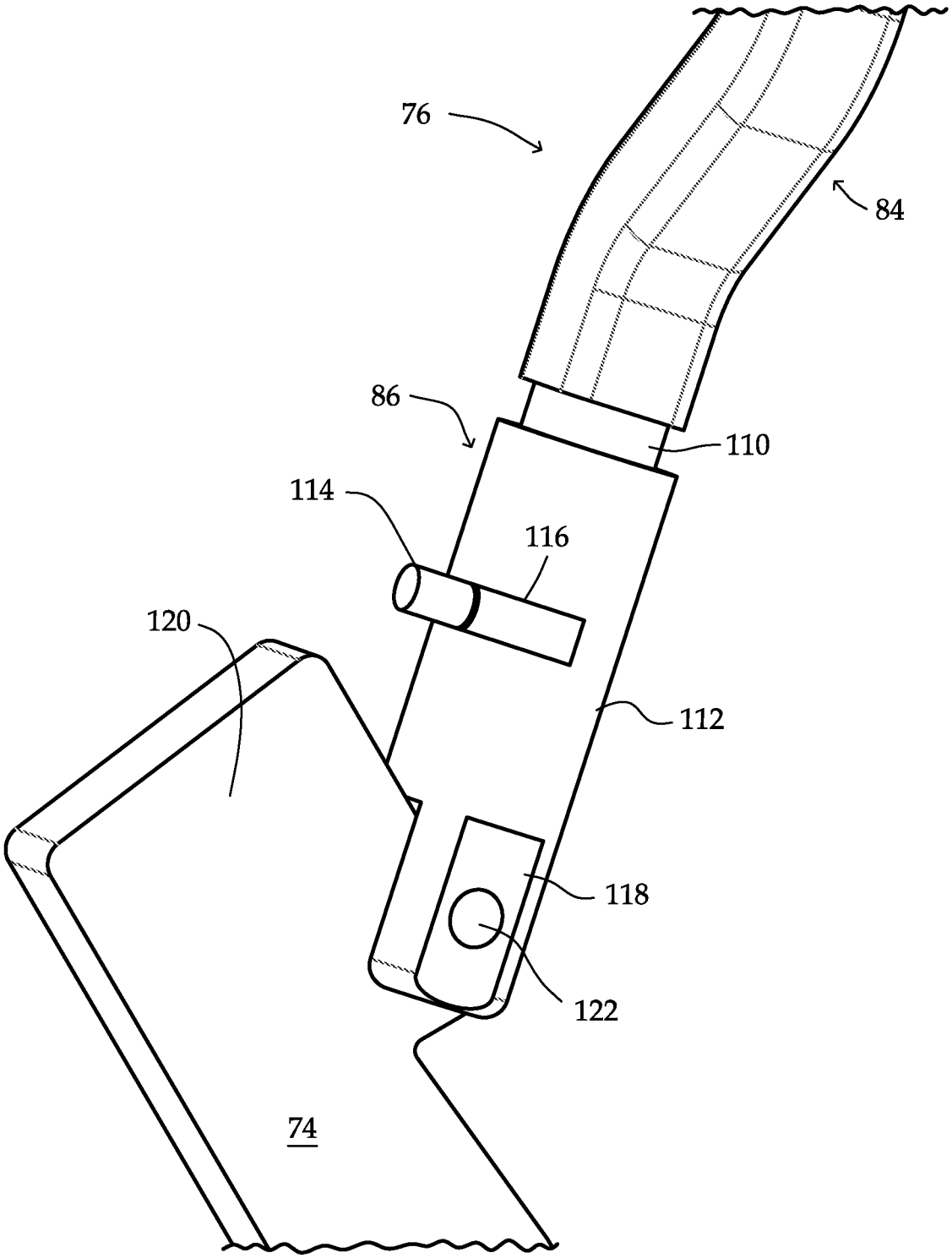
FIG. 6 is an enlarged isolated perspective view of the hinge section of the stirrup assembly.

The stirrup pivot section 86 is shown in an isolated and enlarged view in FIG. 6. As seen therein, stirrup neck portion 84 terminates in a tubular section 110 which extends into barrel section 112. A pin 114 is connected to the tube section 110 and extends through a slot 116 in the barrel section 112. In this arrangement, the neck portion 84 of foot stirrup 76 is allowed to rotate relative to the barrel section 112 and the degree of rotational movement is limited by the pin 114 and slot 116. In one embodiment, the rotational movement is approximately 90°. Accordingly, the loop portion 82 of the foot stirrup 76 can be rotated from the position shown in FIG. 4, where aperture 83 is shown oriented perpendicular to the plane of the stirrup slide 74 and ready to accommodate the foot of a patient, to the position shown in FIG. 5 where aperture 83 is shown oriented parallel to the plane of the stirrup slide 74.

With further reference to FIG. 6, the barrel section 112 is provided with two parallel extensions 118 (only one being shown in FIG. 6). The extensions 118 are spaced apart from one another to form an opening to accommodate the terminal end 120 of stirrup slide 74. A pivot pin 122 traverses each of the extensions 118 and the stirrup slide 74, whereby the barrel section 112 and foot stirrup 76 can be pivoted toward the stirrup slide 74.

With reference now made to FIG. 4, the foot stirrup 76 is shown in the "use" position. To retract the foot stirrup, the loop portion 82 would be rotated approximately 90° to orient the loop portion 82 into the position shown in FIG. 5. The foot stirrup 76 would then be pivoted toward the arm 16 so that the barrel section 118 was adjacent to the stirrup slide 74. Because of the offset feature in the neck portion 84, the loop portion 82 of foot stirrup 76 would be disposed between the stirrup slide 74 and the inner panel 66 of lower section 62 of arm 16, and also positioned to be received within the opening 68 formed between the inner panel 66 and outer panel 64 of lower section 62. At this point, using knob 80, for example, the foot stirrup 76 can be pushed toward the arm 16 until the face plate 78 makes contact with arm 16 to conceal the stirrup 76 within the arm. To use the stirrup, the process is reversed.

The illustrations and examples provided herein are for explanatory purposes and are not intended to limit the scope of the appended claims.

I claim:

1. An examination chair comprising a seating surface; a back surface; a pair of arms, each arm disposed laterally outward and extending upward relative to an opposite side of the seating surface; a lift for raising and lowering the seating surface; and a pair of stirrup members, each stirrup member received within a respective arm; wherein each stirrup member comprises a foot stirrup; a stirrup slide and a stirrup slide tube; wherein the stirrup slide tube is disposed within a channel in the respective arm, the stirrup slide is disposed for sliding movement within the stirrup slide tube, and wherein the foot stirrup is connected to a terminal end of the stirrup slide.

2. The examination chair of claim 1, wherein the back surface reclines.

3. The examination chair of claim 1, wherein the lift comprises a lower carriage and an upper carriage operationally connected to one another by a lifting device and two pairs of scissor arms.

4. The examination chair of claim 3, wherein the lower carriage comprises a rectangular structure having tubular members that form the longer lengths of the rectangular structure, a flat plate member that forms the front rail, and a tubular member that forms a rear cross rail, wherein the front rail and rear cross rail are fixedly secured to the tubular members by welding.

5. The examination chair of claim 4, wherein the lower carriage further comprises four castor tubes located at corners thereof, each castor tube containing a castor to facilitate movement of the examination chair.

6. The examination chair of claim 3, wherein the lift upper carriage comprises a rectangular structure having a pair of long tubular members which form the longer sides of the rectangular structure, and a pair of short tubular members which form the shorter sides of the rectangular structure, a forward cross brace connected to each of the longer tubular members to provide structural rigidity to the upper carriage and also provides a mounting location for one end of the lifting device, wherein an opposite end of the lifting device is connected to the rear cross rail of the lower carriage.

7. The examination chair of claim 6, wherein the each pair of scissor arms comprise rigid metal bars connected to one another such that one scissor arm is rotatable relative to the other scissor arm about a center point of the scissor arm, wherein a rearward end of each scissor arm is pivotally attached to the long tubular members of the upper or lower carriages and a forward end of each scissor arm contains a roller, wherein the rollers are disposed within channel rails attached to the long tubular members.

8. The examination chair of claim 3, wherein the lifting device is electrically operated.

9. The examination chair of claim 1, wherein each arm comprises an upper section pivotally connected to a lower section by at least one hinge, whereby the upper section may be pivoted from a first position in which the upper section is co-planar with the lower section and a second position in which the upper section is adjacent and parallel to the lower section.

10. The examination chair of claim 1, wherein the foot stirrup comprises a loop portion, said loop portion defining an aperture for receiving a portion of a foot of a patient; a pivot section connected to the terminal end of the stirrup slide; and a neck portion connecting the pivot section to the loop portion.

11. The examination chair of claim 10, wherein the pivot section comprises a barrel section having a pair of spaced apart extensions; wherein the pivot section is connected to the stirrup slide by a pin extending through the stirrup slide and each of the extensions; whereby the barrel section of the pivot section can pivot between a use position in which the barrel section is oriented substantially perpendicular to a longitudinal axis of the stirrup slide and a storage position wherein the barrel section is oriented substantially parallel to the longitudinal axis of the stirrup slide.

12. The examination chair of claim 11, wherein the neck portion has a tubular section, wherein the tubular section is disposed within the barrel section for rotational movement therein; wherein the barrel section further comprises a slot; and a pin connected to the neck portion of the foot stirrup and disposed within the slot to limit the rotational movement of the foot stirrup.

13. The examination chair of claim 1, wherein the stirrup slide further comprises a detent feature to provide positive stop points for the extension or retraction of the stirrup slide.

14. The examination chair of claim 10, wherein the neck portion has an s-shaped configuration.

15. The examination chair of claim 1, wherein each arm comprises an outer wall and an inner wall, wherein the inner and outer walls are in spaced apart relation to create an opening within the arm, said opening being adapted to receive the stirrup member therein in a concealed manner.

16. The examination chair of claim 15, wherein the stirrup member further comprises a face plate attached to a terminal end of the stirrup slide, said face plate adapted to cover the opening in the arm when the stirrup is positioned therein.

* * * * *